US007550074B2

(12) United States Patent
Clark et al.

(10) Patent No.: US 7,550,074 B2
(45) Date of Patent: Jun. 23, 2009

(54) PROCESS FOR TREATING FUEL

(75) Inventors: Alisdair Quentin Clark, Aldershot (GB); Spencer Edwin Taylor, Camberley (GB)

(73) Assignee: BP Oil International Limited, London (GB)

( * ) Notice: Subject to any disclaimer, the term of this patent is extended or adjusted under 35 U.S.C. 154(b) by 171 days.

(21) Appl. No.: 10/472,514

(22) PCT Filed: Mar. 19, 2002

(86) PCT No.: PCT/GB02/01334

§ 371 (c)(1),
(2), (4) Date: Sep. 23, 2003

(87) PCT Pub. No.: WO02/079349

PCT Pub. Date: Oct. 10, 2002

(65) Prior Publication Data

US 2004/0129608 A1 Jul. 8, 2004

(30) Foreign Application Priority Data

Mar. 29, 2001 (GB) ..... 0107908.6

(51) Int. Cl.
*C10G 25/00* (2006.01)
*C10L 1/04* (2006.01)

(52) U.S. Cl. ..... 208/307; 208/12; 208/16; 208/212; 208/299; 44/389; 210/282; 210/690; 502/63

(58) Field of Classification Search ..... 44/389; 208/12, 16, 212, 299, 307; 502/63; 210/282, 210/390

See application file for complete search history.

(56) References Cited

U.S. PATENT DOCUMENTS 1,277,328 A 8/1918 McAfee (Continued)

FOREIGN PATENT DOCUMENTS

CH 74331 10/1916

(Continued)

OTHER PUBLICATIONS

Carbon Black is not Activated Carbon, Cabot Carbon Black Grades, CABOT, Web Page, Jan. 2007.*

(Continued)

*Primary Examiner*—Glenn Caldarola
*Assistant Examiner*—Prem C. Singh
(74) *Attorney, Agent, or Firm*—Nixon & Vanderhye

(57) ABSTRACT

A process for preparing a gasoline including blending appropriate components together to prepare a gasoline having a final boiling point of less than 200° C. and contacting the blended gasoline as a whole with a decolorizing, activated carbon. The carbon removes at least some of the following trace impurities: indanes, naphthalenes, phenanthrenes, pryene, alkylbenzene, and mixtures thereof. The prepared gasoline, when combusted, can provide reduced deposits.

11 Claims, 1 Drawing Sheet

U.S. PATENT DOCUMENTS

Figure 1:
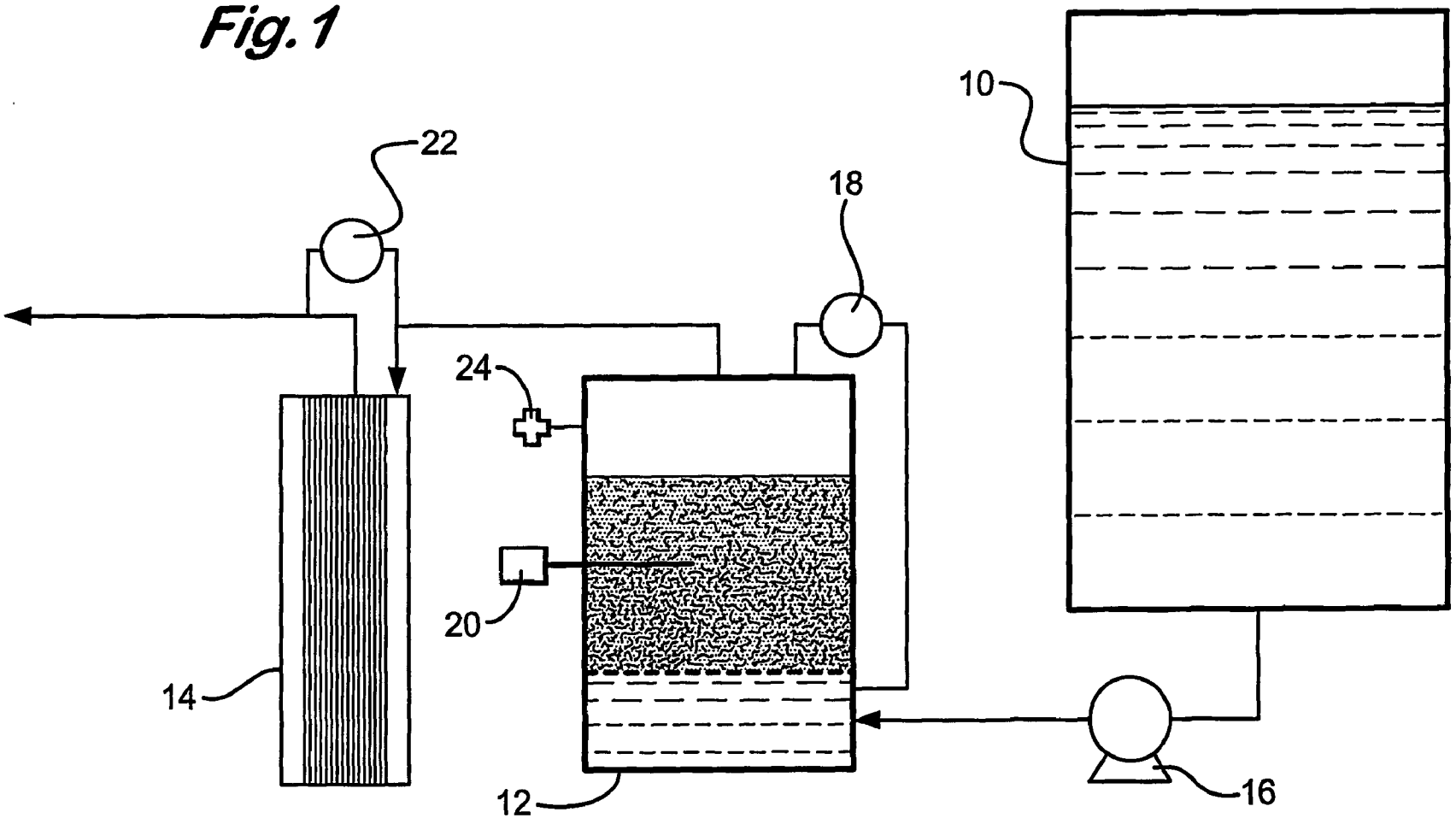

| | | | | | |
|---|---|---|---|---|---|
| 1,559,054 | A | | 10/1925 | Smith | 502/423 |
| 1,649,384 | A | | 11/1927 | Blumenberg, Jr. | |
| 1,695,251 | A | | 12/1928 | Kalichevsky | |
| 1,792,625 | A | | 2/1931 | Baylis | |
| 1,856,571 | A | | 5/1932 | Lourens | |
| 1,951,205 | A | | 3/1934 | Rather et al. | 44/9 |
| 2,368,261 | A | | 1/1945 | Neef, Jr. | 196/39 |
| 2,369,124 | A | | 2/1945 | Allan | 210/122.1 |
| 2,848,379 | A | | 8/1958 | Rehner et al. | 196/52 |
| 3,309,310 | A | | 3/1967 | Blanchard | 206/255 |
| 3,340,316 | A | | 9/1967 | Wackher et al. | 260/674 |
| 3,907,516 | A | * | 9/1975 | Biasotti et al. | 44/389 |
| 3,920,540 | A | | 11/1975 | McCoy et al. | |
| 4,695,386 | A | | 9/1987 | Berry | |
| 4,728,435 | A | | 3/1988 | Mueller et al. | |
| 4,746,368 | A | | 5/1988 | Frank et al. | |
| 4,755,280 | A | | 7/1988 | Hudson et al. | |
| 4,963,519 | A | * | 10/1990 | Okabayashi et al. | 502/63 |
| 4,992,157 | A | * | 2/1991 | Bricker et al. | 208/12 |
| 5,207,894 | A | | 5/1993 | Presnall et al. | |
| 5,403,470 | A | | 4/1995 | Kokayeff et al. | |
| 5,429,747 | A | | 7/1995 | Carr et al. | |
| 5,435,907 | A | | 7/1995 | Sudhakar et al. | |
| 5,449,452 | A | | 9/1995 | Sudhakar et al. | |
| 5,454,933 | A | * | 10/1995 | Savage et al. | 208/212 |
| 5,462,651 | A | | 10/1995 | Sudhakar et al. | |
| 5,472,595 | A | | 12/1995 | Sudhakar et al. | |
| 5,538,929 | A | | 7/1996 | Sudhakar et al. | |
| 5,593,567 | A | | 1/1997 | Jessup et al. | 208/46 |
| 5,651,878 | A | | 7/1997 | Sudhakar et al. | |
| 5,676,822 | A | | 10/1997 | Sudhakar | |
| 5,710,092 | A | | 1/1998 | Baker | |
| 5,837,640 | A | | 11/1998 | Sudhakar et al. | |
| 5,837,867 | A | * | 11/1998 | Lin et al. | 540/200 |
| 5,847,224 | A | | 12/1998 | Koga et al. | 568/699 |
| 5,900,153 | A | * | 5/1999 | Sanford | 210/690 |
| 5,928,501 | A | | 7/1999 | Sudhakar et al. | 208/263 |
| 6,277,780 | B1 | | 8/2001 | Beckler et al. | 502/160 |
| 6,482,316 | B1 | * | 11/2002 | Bal | 208/299 |
| 2004/0129608 | A1 | | 7/2004 | Clark et al. | |
| 2004/0200758 | A1 | | 10/2004 | Yang et al. | |
| 2004/0256320 | A1 | | 12/2004 | Den Boestert et al. | |

FOREIGN PATENT DOCUMENTS

| | | | | |
|---|---|---|---|---|
| DE | 10026693 | | 12/2000 | |
| DE | 10026693 | A1 | 12/2000 | |
| EP | 1514917 | A | 3/2005 | |
| FR | 637022 | | 4/1928 | |
| FR | 637032 | | 4/1928 | |
| GB | 279834 | | 2/1929 | |
| GB | 335952 | | 10/1930 | |
| JP | 64-20446 | | 1/1989 | |
| JP | 06136370 | | 5/1994 | |
| JP | 6136370 | | 5/1994 | |
| JP | 1020446 | | 8/1998 | |
| JP | 2000192054 | | 7/2000 | 65/2 |
| JP | 2001131565 | | 5/2001 | 1/6 |
| WO | 9207046 | | 4/1992 | |
| WO | WO 2004045767 | | 6/2004 | |

OTHER PUBLICATIONS

*Kirk-Othmer Encyclopaedia of Chemical Technology*, 3rd Ed., vol. 4, p. 562-570.

References to internet sites and textbook/encyclopaedias.

Shiyou Lianzhi (1993), 24(12), 36-40 (abstract).

*Kirk-Othmer Encyclopaedia of Chemical Technology*, 3rd Ed., vol. 1, p. 577 and vol. 6, p. 216-7 and p. 223.

*Perry, Chemical Engineers' Handbook*, 4th Ed., 16-4, Table 16-2.

*Vogel's Textbook of Practical Organic Chemistry*, 5th Ed., p. 140.

Calgon, Product Data, "Activated Carbon Products for Liquid and Vapor Phase Applications".

*Westvaco*, Product Data for Nuchar WV-B.

*Waseda Applied Chem. Soc. Bull.* No. 26, 13-28 (1936). (Abstract only.).

*Waseda Applied Chem. Soc. Bull.* No. 24, 1-8 (1935). (Abstract only.) No. 12, 28-9 (1937).

*J. Sac. Waseda Applied Chem.* 1930, No. 12, 6-13. (Abstract only.).

*Scifen-Ole-Fette-Wachse* 78, 23-6 (1952). (Abstract only.).

*Schifensieder-Zig.* 68, 301-2 (1941). (Abstract only.).

Application Requirements and Specifications of Fuels; *Engineering of Petroleum and Refining* 2nd edition, vol. 1, pp. 132 and 142.

Catalytic Cracking; *Engineering of Petroleum and Refining* 2nd edition, vol. 2, p. 3.

Abu Bakr S. H. Salem, Ind. Eng. Chem. Res. 1994, 33, 336-340: "Naptha Desulfurization by Adsorption".

Keith Owen & Trevor Coley, "Automotive Fuels Reference Book", 2nd Edition, Society of Automotive Engineers, Chapters 8 & 9.

Office Action from corresponding Japanese Patent Application No. 2002-578356, date of draft Oct. 30, 2007, 5 pgs, with English Translation.

Citation from Office Action from Japanese Patent Office, "Purification Process of Oil", partial translation and letter from our agents dated Feb. 4, 2008 with bibliographic details.

Translations of Japanese Industrial Standards JIS K2202-1991 and JIS K2202-1996 cited in Office Action from Japanese Patent Office.

Abu Bakr S. H. Salem, Ind. Eng. Chem. Res. 1994, 33, 336-340: "Naptha Desulfurization by Adsorption".

Keith Owen & Trevor Coley, "Automotive Fuels Reference Book", 2nd Edition, Society of Automotive Engineers, Chapters 8 & 9, 1995.

Brown et al; "Activated Charcoal Cloth as a 'Support' for Copper in the Decomposition of Formic Acid"; *Carbon*, vol. 27, No. 2; pp. 171-176 (1989).

"Carbon (Carbon and Artificial Graphite)"; Kirk-Othmer 3 sup. rd. Ed. vol. 4; pp. 562-569, (2003).

Freeman, et al; "Studies of Activated Charcoal Cloth. IV. Influence of Phosphate Impregnants on the Rate of Activation in Carbon Dioxide Gas"; *Carbon*, vol. 26, No. 4; pp. 501-505 (1988).

* cited by examiner

PROCESS FOR TREATING FUEL

The present invention relates to a process for treating fuel and in particular to a process for decolourising a gasoline hydrocarbon fuel.

Hydrocarbon fuels, commonly sourced from crude oil, are used in many applications, for example as transport fuels, power generation, heating and lighting. Typically, the products available from the simple distillation of crude oil undergo further processing to provide materials of sufficient quality for market use. Examples of such processes include a) cracking and hydrocracking of high boiling material to lower boiling products; b) reforming and isomerisation to provide better combustion quality, and c) alkylation/polymerisation to convert gases to liquids.

In addition to these standard processes, a number of methods to improve product quality by the removal or transformation of impurities exist, for example, d) hydrotreatment to remove sulphur species; e) Merox and copper sweetening to convert/remove sulphur species; and f) clay treatment to remove surface active species.

The utilisation of current processing and purification processes yield products of appropriate quality for market use. However, as the products originate from a natural source, often trace amounts of coloured species remain or are formed through further processing, giving the finished product a yellow/green or other colouration. Such a colouration may be detrimental to the product's market acceptance as a high quality material, or cause complications where dyes must be added to give a specific colour for customs or duty purposes.

It is known to produce water-white gasoline using distillation to remove high-boiling, colour-forming compounds.

The decolourisation of asphalt-kerosene solutions is described by Ken-ichi Yamamoto et al in CA 32:4761a and CA 32:4761c. A variety of adsorbents including activated carbon are used. The decolourising power of acid clay is also described in CA 25:2840. Decolourising kerosene, gasoline and petroleum distillates using clay is described in CA 23:698a. Removal of lead tetraethyl and colouring matter from leaded gasoline using hydrated Al silicate is described in CA 39:3659[2]. Use of activated clay is also described in CA 39:4470h. Decolourising and deodorising cracked gasoline with aluminium chlorosulphate is described by CA 22:498a. Decolourisation of light oil by contacting with activated carbon is described in JP6136370.

A novel and simple industrial method for the removal of trace amounts of coloured species from gasoline has been found.

According to the present invention, there is provided a process for decolourising a liquid hydrocarbon fuel which is a gasoline, the process comprising contacting at least part of the liquid gasoline with a decolourising carbon.

It has been found that contacting the gasoline with the decolourising carbon removes at least some of trace impurities selected from the group consisting of indanes, naphthalenes, phenanthrenes, pyrene, alkylbenzenes and mixtures thereof.

Thus according to a further aspect of the present invention there is provided a process for removing from liquid hydrocarbon fuels, especially gasoline, at least some of trace impurities selected from the group consisting of indanes, naphthalenes, phenanthrenes, pyrene, alkylbenzenes and mixtures thereof, the process comprising contacting at least part of the liquid hydrocarbon fuel, especially gasoline, with a decolourising carbon. The fuel may be a diesel fuel or preferably, a gasoline. Where the fuel is a diesel fuel, the fuel may be suitable for fueling any known type of diesel engine, for example, a motor diesel engine or a marine diesel engine. Where the fuel is a gasoline, the fuel may be a motor gasoline or aviation gasoline for use in any spark ignition engine. The fuel may be a kerosene for use in an aviation turbine engine as jet fuel or for use in a ground based turbine engine. Alternatively, the kerosene may be used as a fuel for heating or lighting and the clear product may have a dye introduced to differentiate it as such.

It has been found that the present invention produces a gasoline product which in use, produces less engine deposits compared to untreated gasoline. In particular, in use, the gasoline product unexpectedly produces significantly reduced combustion chamber deposits. In one experiment at least, the deposits were found to be reduced to a level below that which is achieved using a known gasoline detergent additive. Furthermore, the gasoline product in use produces reduced inlet manifold deposits. These benefits may reduce or even eliminate the need for the use of gasoline detergent additives.

Thus, according to another embodiment of the present invention there is provide the use in a spark ignition engine, of a gasoline according to the present invention to reduce engine deposits, preferably to reduce the engine deposits formed in at least one location selected from the group consisting of the engine inlet system, engine inlet valves, engine combustion chamber and engine exhaust system.

Also, the present invention provides a method of reducing engine deposits which comprises combusting in a spark ignition engine, a gasoline produced by a process according to the present invention preferably in which reduced engine deposits are formed in at least one location selected from the group consisting of the engine inlet system, engine inlet valves, engine combustion chamber and engine exhaust system.

The gasoline of the present invention has been found to particularly reduce deposits in the engine combustion chamber. Thus advantageously, the gasoline of the present invention may be used in a direct injection gasoline engine where it is introduced directly into the combustion chamber.

The present invention also reduces the sulphur content of the liquid gasoline which may assist in achieving very low sulphur contents in the gasoline product.

The present invention also provides a method of producing water-white gasoline without the need for distillation to remove high-boiling, colour-forming compounds.

Preferably, the liquid fuel (gasoline) is passed through a carbon filter bed to remove trace colouration. However, it may also be possible to introduce particles of the decolourising carbon into the fuel (gasoline), and then remove these particles from the fuel (gasoline) after treatment. Any carbon source may be used to prepare the decolourising carbon employed in the present invention. However, carbon sourced from wood, coconut or coal is preferred. The carbon may be activated for example, by acid, alkali or steam treatment. Suitable decolourising carbons are described in Kirk-Othmer Encyclopedia of Chemical Technology, 3$^{rd}$ Edition, Vol 4, pages 562 to 569. Preferred decolourising carbons can be obtained from Norit, General Filtration, CPL Carbon Link and Fengroup.

The fuel (gasoline) may be sourced from crude oil: for example, the gasoline may comprise a crude oil distillate. Preferably, the fuel or gasoline comprises a crude oil distillate which has been treated by one or more of the following processing steps: a) cracking and/or hydrocracking; b) reforming and isomerisation, and c) alkylation/polymerisation. The crude oil distillate may also have been treated to improve product quality by the removal or transformation of impurities. Such treatment steps include d) hydro-treatment to remove sulphur species; e) Merox and copper sweetening to convert/remove sulphur species; and f) clay treatment to remove surface active species. The fuel (gasoline) may also contain components which originate from other sources, such as chemical processes for the manufacture of aromatics, ethers or material derived from biomass such as ethanol or methanol.

Preferably, the fuel (gasoline) comprises at least one paraffinic fraction of crude oil or derived from crude oil. The fuel (gasoline) may comprise at least 20 vol %, more preferably, at least 40 vol % of this paraffinic fraction. Typically, the paraffinic fraction comprises at least one saturated aliphatic hydrocarbon of 4 to 20 carbon atoms. Preferably, the aliphatic hydrocarbon comprises 4 to 12 carbon atoms. These aliphatic hydrocarbons may be linear or branched. Suitable linear hydrocarbons include n-butane, n-pentane, n-hexane, n-heptane, n-heptane, n-octane, n-nonane, n-decane, n-undecane and n-dodecane. Suitable branched chain hydrocarbons include alkanes of 4 to 8 carbon atoms having at least one branch (e.g. 2 or 3 branches) in their alkyl chain. Examples of suitable branched alkanes include iso-butane, iso-pentane, iso-hexane, and iso-octane.

The fuel (gasoline) may also comprise at least one olefin. Preferably, however, the olefin content of the fuel (gasoline) is less than 20 vol %, more preferably, less than 10 vol %. Where an olefin is present in the fuel (gasoline), the olefin may be an alkene of 5 to 10, for example, 6 to 8 carbon atoms. Such alkenes may be linear or branched. Suitable examples include pentene, iso-pentene, hexene, iso-hexene, heptene or 2-methyl-pentene and a mixture thereof Such alkenes may be produced by any suitable method known in the art, for example, by catalytically or thermally cracking a residue from crude oil.

The fuel (gasoline) may also comprise aromatics. Preferably, however, the aromatic content of the fuel (gasoline) is less than 50 vol %, more preferably, less than 35 vol %, even more preferably, less than 25 vol % and most preferably, less than 10 vol %. Suitable aromatic compounds that may be present in the fuel include toluene, o-, m-, p-xylene and trimethylbenzenes. Mixtures of aromatic compounds may also be present. Such mixtures may be derived from catalytically reformed or cracked gasoline obtained, for example, from heavy naphtha. Preferably, the fuel (gasoline) is substantially free of benzene, for example less than 1 vol %.

The fuel (gasoline) may also contain at least one oxygenate. Suitable oxygenates include alcohols and ethers, such as ethanol and dialkyl ethers. Preferably, an asymmetric ether is employed. Examples include methyl tertiary-butyl ether (MTBE), ethyl tertiary-butyl ether and methyl tertiary-amyl ether. Preferably, the amount of oxygenate in the fuel (gasoline) is less than 15 vol %.

Preferably, the final boiling point of the fuel (gasoline) is less than 200° C., more preferably, less than 180° C., for example, between 155 and 175° C.

The sulphur content of the fuel (gasoline) is preferably less than 10 ppm, more preferably, less than 5 ppm, even more preferably, less than 1 ppm, and most preferably, less than 0.5 ppm.

The fuel (gasoline) of the present invention may have a Motor Octane Number (MON) of at least 82, and a Research Octane Number (RON) of at least 92. Preferably, the fuel (gasoline) has an MON of 85 to 90, and an RON of 95 to 100.

The fuel (gasoline) of the present invention may have a Reid Vapour Pressure (RVP) of 30 to 110 kPa, preferably 30 to 60 kPa.

The density of the fuel (gasoline) may be greater than 0.60 g/cm$^3$, preferably greater than 0.70 g/cm$^3$, more preferably, greater than 0.72 g/cm$^3$. Preferably, the density of the fuel (gasoline) does not exceed 0.775 g/cm$^3$.

The fuel (gasoline) may be prepared by any suitable method, for example, by blending appropriate components together. In one embodiment, the fuel (gasoline) is prepared by blending iso-paraffin (alkylate), hydrocrackate and isomerate together. The amount of iso-paraffin employed may be such that it forms 20 to 80 vol %, preferably, 50 to 70 vol %, for example, 60 vol % of the final fuel (gasoline) composition. The amount of hydrocrackate employed may be such that it forms 5 to 35 vol %, preferably, 10 to 30 vol %, for example, 20 vol % of the final fuel (gasoline) composition. The amount of isomerate employed may be such that it forms 10 to 50 vol %, preferably, 20 to 40 vol %, for example, 30 vol % of the final fuel (gasoline) composition. It may also be desirable to include reformate and/or Full Range Catalytically Cracked Spirit (FRCCS) in the fuel (gasoline) composition. The former may be employed in an amount of 0 to 40 vol %, for example, 20 vol %; the latter, in an amount of 0 to 30 vol %, for example, 15 vol %.

Part of the fuel (gasoline) may be treated according to the present invention by contacting one or more of the components which comprise the fuel (gasoline) separately or together with the carbon before combining them to produce a fuel (gasoline) final product. Alternatively, the fuel (gasoline) comprising one or more components may be treated as a whole.

The fuel (gasoline) may be a motor gasoline or aviation gasoline for use in any spark ignition engine.

The fuel (gasoline) gasoline may contain conventional additives, such as gasoline detergent additives. An example of a detergent additive is a PIB amine detergent additive. Preferably, at least some of the additive remains in the fuel (gasoline), or is added to the gasoline after treatment with the present invention. Preferably gasoline prepared by the present invention is substantially free of gasoline detergent additive.

Prior to treatment by the method of the present invention, the gasoline may have an IP17 yellow/blue rating of greater than 5 yellow/greater than 5 blue, for example, greater than 7 yellow/greater than 7 blue. In one embodiment, the gasoline has an IP17 rating of 9 yellow/10 blue. After treatment by the present invention, the gasoline may have an IP 17 yellow/blue rating of less than 5 yellow/less than 5 blue, for example, less than 3 yellow/less than 3 blue, preferably, less than 1 yellow/less than 1 blue. In one embodiment, the gasoline has an IP 17 rating of 0.7 yellow/0.5 blue after treatment. In another embodiment, the gasoline has an IP17 rating of 0.1 blue after treatment. The gasoline is preferably water-clear after treatment by the present invention. (N.B. IP17 is the Institute of Petroleum Standard Test for colour determination).

According to the process of the present invention, the Saybolt colour rating of the gasoline prior to contacting with the carbon may be less than 10 and after contacting with the carbon may be greater than 20.

These and other aspects of the invention will now be described with reference to FIG. 1, which is a schematic diagram of an apparatus suitable for carrying out an embodiment of the present invention.

FIG. 1 depicts an apparatus comprising a gasoline tank 10, a filter unit 12 and a monitoring unit 14. The gasoline tank 10 contains 2500 litres of gasoline. The filter unit 12 consists of a 205 litre drum, which houses a filter bed of acid-activated carbon granules (180 kg). The monitoring unit 14 comprises an additional filter, which is suitable for removing trace carbons and water.

In operation, a pump 16 is used to pump the gasoline from the tank 10 into the filter unit 12. The gasoline flows through the filter bed at a rate of 1.1 $m^3$ per hour. A differential pressure is applied across the bed, and is maintained at less than 15 cm water as measured by the gauge 18.

On start-up, the temperature of the filter unit 12 is monitored by a thermocouple 20. It is desirable to maintain the temperature of the filter unit 12 below a threshold of 30° C., to ensure that the lighter gasoline components do not boil. However, if the threshold temperature is exceeded, a pressure relief valve 24 may be opened to vent any excess pressure safely. Once the gasoline has completely filled filter unit 12, steady-state operation is achieved, and no farther temperature rise is experienced.

Once filtered, the gasoline is passed to the monitoring unit 14, where any traces of carbon granules or water entrained in the product are removed. A differential pressure is applied across the monitoring unit 14, and this is maintained at less than 15 cm water, as measured on gauge 22.

The decolourised product is then removed from the monitoring unit 14, and transferred to a storage tank or drum.

EXAMPLE 1

In this example, 500 ml of normal gasoline (with typical green colouration) was tested according to the Institute of Petroleum standard test method 17 for colour determination (IP17). This test compares the sample to a series of red, yellow and blue reference colours. The higher the number, the more coloured the sample.

The gasoline was then passed through a filter column, ca. 20 cm long, 2 cm in diameter with a glass sinter to retain the carbon. The colour of the filtered gasoline was then measured according to IP17. The results are shown in the table below.

| Test | Base Fuel, Gasoline | Base Fuel Post Granulated Carbon |
|---|---|---|
| Colour IP17 | 9.0 Yellow/10.0 Blue | 0.7 Yellow/0.5 Blue |
| Detergent additives mg/100 ml | 68 | 43 |

The test demonstrated that post the carbon filter, the green coloration was practically all removed from the sample. In addition, and surprisingly, the carbon filter did not remove all of the detergent additive (of the PIB amine type), demonstrating particular affinity for the fuel-derived coloured species.

EXAMPLE 2

Example 1 was repeated the acid washed, activated carbon:

| Test | Base Fuel, Gasoline | Base Fuel Post Activated Carbon |
|---|---|---|
| Colour IP17 | 9.0 Yellow/10.0 Blue | 0.1 Blue |
| Detergent additives mg/100 ml | 68 | 32 |

Only a trace of blue colouration remained and again, not all the PIB detergent additive was removed.

Further Experiments.

The following further decolourisation experiments were performed using a 500 ml flask fitted with a condenser, stirrer and temperature indicator. 150 g of gasoline was originally used along with a dose of various activated carbons from various sources. This size preparation allowed a visual check of colour removal to be carried out before larger samples were processed. The results are shown in Table 1 below.

TABLE 1

| Carbon source | Amount of carbon % w/v with respect to gasoline | Volume gasoline (ml) | Time (hours) | Saybolt colour | Comments |
|---|---|---|---|---|---|
| Aldrich #161551 | 0.35 | 215 | 5.5 | No change | Gasoline added to carbon - no exotherm |
| | 0.35 | 215 | 5.5 | No change | Carbon added to gasoline - no exotherm |
| BP Oil CPL | 0.17 | 2143 | 14 | +19 | |
| | | | 19.25 | +19 | 0.17% (3.75 g) added |
| BP Oil CPL | 0.7 | 2143 | 5 | +21 | |
| | | | 9.75 | +21 | |
| | | | 12.25 | +20 | |
| Sutcliffe Speakman DCL Mesh: 12 × 40 US | 0.35 | 2143 | 1.5 | +20 | |
| | | | 4.25 | +20 | |
| | | | 9.75 | | |
| Aldrich #161551 | 0.5 | 1500 | 1 | +23 | Carbon furnace dried at 140 for 7 hours |
| | | | 2 | +23 | |
| | | | 3 | +23 | |
| Norit CA3 | 0.5 | 1500 | 1 | +24 | |
| | | | 3 | +23 | |

The Saybolt analysis of the starting material was +2.

The results in Table 1 show that it was necessary to dry the Aldrich carbon at 140 degrees Celsius for 7 hours prior to use. When the experiment was repeated a Saybolt colour of +23 was achieved after a residence time of only 1 hour. The most successful carbon sample, in terms of colour improvement, is evidently the Norit CA3. At a dose of 0.5% w/v of gasoline a Saybolt of +24 was achieved after only 1 hour. Handling of this grade of carbon may prove slightly problematic due to the presence of fines.

The next most successful result was a colour of +20 achieved by a sample obtained from Sutcliffe Speakman in about the same length of time but at a lower dose of 0.35% w/v of gasoline. The CPL granular carbon sample, supplied by BP Oil, produced a Saybolt colour of +19 after a residence time of 14 hours at a dose of 0.17% w/v. When more of this carbon was added, there was no improvement in colour. This suggests that the carbon was already present in excess at the original dose.

It might be possible to use a mixture of carbons, for example a mixture the Sutcliffe Speakman and Norit carbon samples Engine Tests.

2000 litres of gasoline was divided into two lots each of 1000 litres. 1000 litres was contacted with an activated carbon to give a decolourised product. 1000 litres was put to one side as a baseline fuel. The two fuels were compared for engine deposit forming tendency using an industry standard test featuring a Mercedes engine (M102E Test) running on 300 litres of fuel. The results are shown in Table 2.

Visual rating of deposit formation in the inlet system (manifold, inlet port, inlet throat and inlet valve tulip) were recorded. Deposit weights were recorded for the inlet valve (tulip deposits, tulip solubles, face deposits and valve wear)

and for the combustion chamber (piston crown and cylinder head). Deposit thickness measurements were made for the combustion chamber (piston crown and cylinder head).

TABLE 2

| Engine Component | Base fuel | Decolourised fuel | Base fuel + Additive | Decolourised fuel + Additive |
|---|---|---|---|---|
| Visual Ratings | | | | |
| Inlet manifold branch | 8.9 | 8.9 | 8.9 | 8.9 |
| Inlet Port | 8.03 | 8.85 | 8.9 | 8.9 |
| Inlet Throat | 7.8 | 9.08 | 8.9 | 8.9 |
| Inlet Valve Tulip | 8.63 | 8.88 | 9.62 | 9.4 |
| Valve seat rim deposits | Trace/ Medium | Trace/Light | Clean/ Light | Clean/Light |
| Deposit Weights mgs | | | | |
| Tulip Deposits | 83.6 | 43.1 | 15.6 | 26.5 |
| Tulip Solubles | 2.6 | 0.9 | 3.2 | 6.8 |
| Face Deposits | 15.4 | 7.8 | 13.7 | 16.9 |
| Valve Wear | 9.7 | 1.4 | 2.7 | 8.1 |
| Piston Crown Deposits | 511.525 | 362.125 | 498.05 | 497.675 |
| Cylinder Head Deposits | 440.725 | 316.675 | 461.05 | 535.125 |
| Deposit Thickness Measurements microns | | | | |
| Piston Crown | 75.9 | 56.3 | 57.8 | 69 |
| Cylinder Head | 115.7 | 74.3 | 119.5 | 119.7 |

The results in Table 2 show that the decolourised gasoline fuel provides better engine cleanliness than the baseline fuel. The process of the present invention has not only decolourised the fuel, it has selectively removed species which form deposits in the engine.

The decolourised gasoline fuel provides similar performance to the base fuel plus a known gasoline detergent additive (330 mls/$m^3$ of a conventional additive such as BASF Keropur 3540 K5) with the additional benefit of also reducing combustion chamber (piston crown and cylinder head) deposits (this is highly unusual). The gasoline detergent additive provided little additional benefit to the already 'clean' decolourised fuel and in some instances make deposits worse (additive causing carbon in the combustion chamber). The process of the present invention has therefore produced a gasoline fuel which is of low deposit forming nature and no longer necessarily requires a gasoline detergent additive. The process of the present invention has reduced combustion chamber deposits which conventional detergent additives can not achieve.

Careful sulphur determinations for the two fuels indicated that the baseline contained 49 ppm sulphur whereas the gasoline product had 47 ppm sulphur The process of the present invention has therefore provided a useful 'polishing step' where sulphur species have been removed. This may be important in achieving very low sulphur specifications of 10 ppm maximum sulphur. Since it provides a further potential 20% reduction in sulphur content.

The spent carbon from the decolourisation reactor was removed and analysed by desorption mass spec. Results showed the carbon had adsorbed species such as: indanes, naphthalenes, phenanthrenes, pyrene and alkylbenzenes. Only trace quantities of these materials would be present in gasoline and the use of carbon for their selective removal has given benefits in reduced engine deposit formation.

The invention claimed is:

1. A process for preparing a decolorized, liquid gasoline product comprising a gasoline detergent additive, which process comprises:

(a) blending appropriate components from processing and purification processes together to prepare an untreated liquid gasoline having a final boiling point of less than 200° C., a Reid Vapor Pressure of 30 to 110 kPa and a Saybolt color rating of less than 10;

(b) contacting the untreated liquid gasoline as a whole with a decolorizing, activated carbon to form a decolorized gasoline having a Saybolt color rating of greater than 20; and (c) adding a gasoline detergent additive to said decolorized gasoline to form a decolorized liquid gasoline product which in use in a spark ignition engine produces reduced inlet manifold deposits.

2. A process as a claimed in claim 1 in which the sulphur content of the gasoline is reduced.

3. A process as claimed in claim 1 in which the untreated liquid gasoline is passed through a carbon filter bed to remove trace colouration.

4. A process as claimed in claim 1 in which the gasoline is a motor gasoline.

5. A process as claimed in claim 1 in which the gasoline has a density which does not exceed 0.775 g/$cm^3$.

6. A process as claimed in claim 1 in which the Institute of petroleum Standard Test IP17 color rating for the untreated liquid gasoline is greater than 5 yellow/greater than 5 blue and for the gasoline product is less than 5 yellow/less than 5 blue.

7. A process as claimed claim 4 in which the untreated liquid gasoline is passed through a carbon filter bed to remove trace colouration.

8. A process as claimed in in claim 4 in which the institute of Petroleum Standard Test IP17 colour rating for the untreated liquid gasoline is greater than 5 yellow/greater than 5 blue and for the gasoline product is less than 5 yellow/less than 5 blue.

9. A process as claimed in claim 1 in which the gasoline is an aviation gasoline.

10. A process as claimed in claim 9 in which the untreated liquid gasoline is passed through a carbon filter bed to remove trace colouration.

11. A process as claimed in claim 9 in which the Institute of Petroleum Standard Test IP17 colour rating for the untreated liquid gasoline is greater than 5 yellow/greater than 5 blue and for the gasoline product is less than 5 yellow/less than 5 blue.

* * * * *